US005622524A

United States Patent [19]

Dirmeyer

[11] Patent Number: 5,622,524

[45] Date of Patent: Apr. 22, 1997

[54] FILTER PLUG

[75] Inventor: Josef Dirmeyer, Bodenwöhr, Germany

[73] Assignee: Siemens Aktiengesellschaft, Munich, Germany

[21] Appl. No.: 597,242

[22] Filed: Feb. 6, 1996

[30] Foreign Application Priority Data

Aug. 6, 1993 [DE] Germany ..... 43 26 486.7

[51] Int. Cl.[6] ..... H01R 13/66

[52] U.S. Cl. ..... 439/620; 252/62.54; 333/182; 439/933

[58] Field of Search ..... 439/933, 934, 439/620; 252/62.53, 62.54; 333/181–185, 12

[56] References Cited

U.S. PATENT DOCUMENTS 4,970,476 11/1990 Kitagawa ..... 333/12
5,370,555 12/1994 Smoravek ..... 439/620

FOREIGN PATENT DOCUMENTS 363724 4/1990 European Pat. Off. ..... 439/620
9112098 3/1993 Germany .

*Primary Examiner*—Gary F. Paumen
*Attorney, Agent, or Firm*—Herbert L. Lerner; Laurence A. Greenberg

[57] ABSTRACT

One embodiment of a filter plug includes a plug body being constructed as a filter element and being made of insulating material, and a number of parallel plug pins being disposed in a set pattern and being surrounded by the plug body. Another embodiment of a filter plug includes a plug body being made of a compound material having a mixture of insulator and ferrite material, and a number of parallel plug pins being disposed in a set pattern and being surrounded by the plug body. The plug body of the filter plug is made of a mixture of insulating material and ferrite powder in order to suppress undesired interference, such as radio frequency signals. The filter plug may be a pin connector, a blade connector or a jack connector.

4 Claims, 1 Drawing Sheet

FILTER PLUG

CROSS-REFERENCE TO RELATED APPLICATION

This application is a Continuation of International Application Ser. No. PCT/DE94/00892, filed Aug. 1, 1994.

BACKGROUND OF THE INVENTION

Field of the Invention

The invention relates to a filter plug having a plug body being made of insulating material and a number of parallel plug pins being disposed in a set pattern and being surrounded by the plug body.

Such filter plugs are used, on one hand, to provide a plug-in electrical connection and, on the other hand, to block out interference which could be transmitted through that connection. The plugs are usually soldered onto a printed circuit board on which there is a circuit and project through an opening in a housing surrounding the circuit.

In order efficiently to block out interference which is fed into the housing through the contact pins, or interfering radiation which can be radiated onto the contact pins from the circuit, filter elements made of ferrite material are fitted onto the filter plugs, as in German Utility Model DE-U 91 12 098, corresponding to U.S. Pat. No. 5,370,555. The filter elements have bores matching the pattern of the plug pins and they are held in the plug by the contact pins.

Since the plug connector is made of an insulating material, the interfering radiation can enter and leave unimpaired. In order to block out the interfering radiation effectively, relatively large filter elements or screening plates that surround the plug are necessary.

SUMMARY OF THE INVENTION

It is accordingly an object of the invention to provide a filter plug, which overcomes the hereinafore-mentioned disadvantages of the heretofore-known devices of this general type and with which it is possible to block out interference effectively without using a special filter element.

With the foregoing and other objects in view there is provided, in accordance with the invention, a filter plug, comprising a plug body being constructed as a filter element and being made of insulating material; and a number of parallel plug pins being disposed in a set pattern and being surrounded by the plug body.

With the objects of the invention in view, there is also provided a filter plug, comprising a plug body being made of a compound material having a mixture of insulator and ferrite material; and a number of parallel plug pins being disposed In a set pattern and being surrounded by the plug body.

In this case the plug body itself acts as a filter element, since it is made of a mixture of insulating material and ferrite material.

Since a special filter element, and therefore also a holder for the filter element, are not employed, the use of such a filter plug has the advantage of requiring one fewer assembly step. The plug blocks out interference better with the plug body providing both EMC protection and capacitive and/or inductive attenuation. An additional screening plate around the filter plug can therefore be left out.

In accordance with a concomitant feature of the invention, the filter plug is a pin connector, a blade connector or a jack connector.

Other features which are considered as characteristic for the invention are set forth in the appended claims.

Although the invention is illustrated and described herein as embodied in a filter plug, it is nevertheless not intended to be limited to the details shown, since various modifications and structural changes may be made therein without departing from the spirit of the invention and within the scope and range of equivalents of the claims.

The construction and method of operation of the invention, however, together with additional objects and advantages thereof will be best understood from the following description of specific embodiments when read in connection with the accompanying drawings.

DESCRIPTION OF THE PREFERRED EMBODIMENTS

A filter plug according to the invention is used, among other things, for suppressing undesired interference, such as radio frequency signals, parasitic signals or switching spikes. Such a plug can be used in many different ways. In particular, it can be used frequently in automobile electronics. It is primarily used in applications relating to safety, such as air bag systems.

Figure 1:
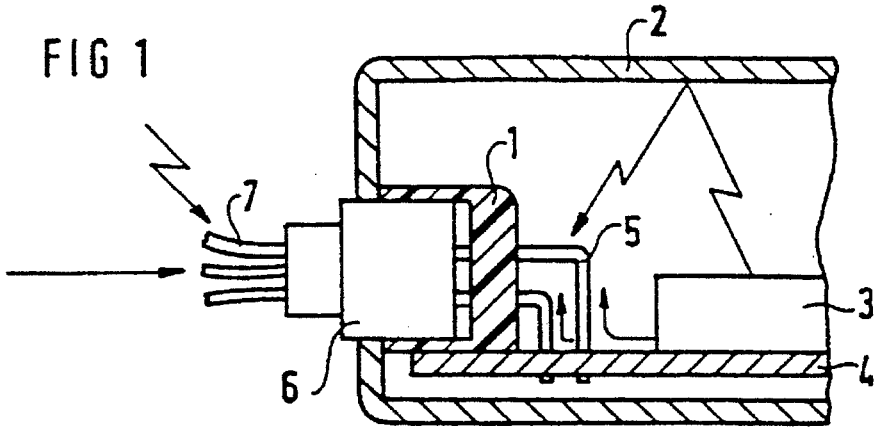
FIG. 1 is a fragmentary, diagrammatic, longitudinal-sectional view of a filter plug according to the invention, as used in a control unit.

Referring now to the figures of the drawing in detail and first, particularly, to FIG. 1 thereof, there is seen an application example of a filter plug 1 according to the invention. An electronic circuit 3 is disposed on a printed circuit board 4 in a metal housing 2 of a control unit. The filter plug 1 is soldered through contact pins 5 thereof onto the printed circuit board 4, and it is therefore electrically connected to the circuit 3. Through the use of the plug 1 and a mating connector 6 plugged into it, the circuit 3 is electrically connected to sensors, a voltage supply or other control units, for example, through the use of a cable 7. The intended purpose of the filter plug 1 is to block out or greatly attenuate both interfering radiation (represented by zigzag arrows) and conduction-related interference (represented by other arrows), which can be fed out of the housing 2 or into the housing 2 through the contact pins 5 or along the cable 7.

A filter plug 1 can be constructed as a pin connector, as represented in the drawings, as a blade connector or as a jack connector. However, the way in which the filter plug 1 is configured is not of importance for the invention.

Figure 2:
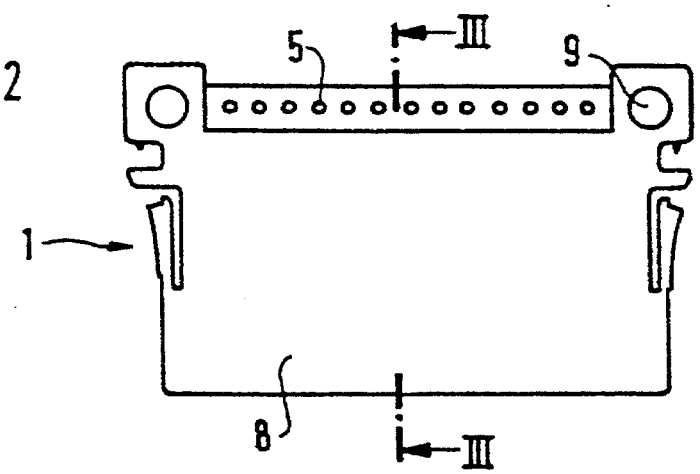
FIG. 2 is a plan view of the filter plug.

The invention is explained in more detail below with reference to FIG. 2 on the basis of a filter plug 1 in the form of a pin connector. The pin connector has a plug body 8 through which the parallel, electrically conductive contact pins 5 which are disposed in a set pattern extend. With the aid of various fastening devices 9 such as, for example, bores, deformable pinch-ribs or latching elements, the pin connector can be fastened on the housing 2 or on the printed circuit board 4.

Figure 3:
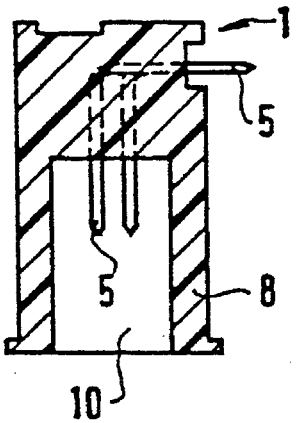
FIG. 3 is a cross-sectional view of the filter plug which is taken along a line III—III of FIG. 2, in the direction of the arrows.

The pin connector has a chamber 10 shown in FIG. 3 that is open toward the back, into which the corresponding mating connector 6 can be plugged. A plug-in electrical contact is thereby produced.

The plug body 8 is constructed as a filter element in order to block out interference which is fed through the contact pins 5 or, in the region of the contact pins 5, through the plug 1. For this purpose, a ferrite material is admixed to the conventional insulating material during production of the plug body 8.

A conventional insulating material for the plug body 8 is polybutylene terephthalate (PBT), for example, to which glass fibers can be admixed for mechanical reinforcement. Before the plug body 8 is injection molded, ferrite material is admixed to the PBT. The best possible homogeneity in the distribution of the ferrite powder is achieved if small quantities of sintered ferrite powder are respectively coated by PBT, so as to yield a granulate made up of PBT and ferrite. This granulate is introduced into the injection molding device and the plug body 8 is injection-molded.

The proportion by weight of ferrite in the granulate depends on the application, i.e. on the type of interference which it is intended to block out or attenuate. In the case of an air bag filter plug 1, the proportion by weight of ferrite powder is approximately 30 to 50% of the total weight of the plug body 8.

A ferrite is a compound made up of iron oxide and other metal oxides. Ferrites are produced by sintering fine pulverulent starting materials at a specific temperature. Ferrites are sufficiently well known for there to be no need to discuss their composition in further detail herein.

Their behavior resembles that of ferromagnetic materials. Since they have a high resistivity and therefore conduct virtually no electricity, they can be used to good effect as filter elements for interference suppression or EMC screening. If a contact pin is surrounded by ferrite material, then RF interference signals or interfering harmonics produce eddy currents in the ferrite material. The eddy currents are converted into heat by virtue of the attenuation properties of the ferrite. The interference signals are therefore attenuated.

These positive properties are retained if the ferrite powder is mixed with PBT, i.e. if the ferrite is finely distributed in the PBT, which represented in FIG. 3 by a hatched area. By using such a PBT and ferrite mixture, it is possible to attenuate radio frequency interference or steep pulse edges.

The mixture also has an inductive attenuation behavior. The filter plug 1 can therefore be used to satisfy high attenuation requirements, in particular for automobile electronics.

The material of which the plug body is made is thus a compound material (also referred to as two-component material), that contains at least an insulator as support and ferrite material admixed thereto.

Since the plug body 8 tightly surrounds the contact pins 5, and since the ferrite also acts as EMC screening, the filter plug 1 makes it unnecessary to have an additional screening plate for the plug 1. During assembly of the plug 1 it is therefore not necessary to ensure that a filter element is fitted, since the plug body 8 is constructed as a filter element.

The filter plug 1 according to the invention also requires less space, since an additional ferrite block is not necessary. A deeper action of the screening or attenuation is achieved by virtue of the plug body 8, since the ferrite material is distributed over the entire plug body 8. The plug body 8 can be constructed in a very simple form, since no mechanical precautions need be taken for holding a filter element.

I claim:

1. A filter plug, comprising:

a plug body being made of a compound material having a mixture of insulator and ferrite material; and a number of parallel plug pins being disposed in a set pattern and being surrounded by said plug body.

2. A pin connector, comprising:

a plug body being made of a compound material having a mixture of insulator and ferrite material; and a number of parallel plug pins being disposed in a set pattern and being surrounded by said plug body.

3. A blade connector, comprising:

a plug body being made of a compound material having a mixture of insulator and ferrite material; and a number of parallel plug pins being disposed in a set pattern and being surrounded by said plug body.

4. A jack connector, comprising:

a plug body being made of a compound material having a mixture of insulator and ferrite material; and a number of parallel plug pins being disposed in a set pattern and being surrounded by said plug body.

* * * * *